US005546612A

United States Patent [19]

Johnson

[11] Patent Number: 5,546,612

[45] Date of Patent: Aug. 20, 1996

[54] AUTOMATIC DOMESTIC TOILET SEAT LOWERING APPARATUS AND DISC BRAKE ASSEMBLY

[76] Inventor: Oriz W. Johnson, 7086 Butterwood Dr., Cincinnati, Ohio 45241

[21] Appl. No.: 427,608

[22] Filed: Apr. 24, 1995

[51] Int. Cl.[6] ..... A47K 13/10

[52] U.S. Cl. ..... 4/248; 4/246.1; 188/72.7; 16/50; 16/342

[58] Field of Search ..... 4/246.1, 248, 236, 4/240; 188/72.1, 72.7, 72.9; 16/49, 50, 337, 341, 342

[56] References Cited

U.S. PATENT DOCUMENTS

| | | | |
|---|---|---|---|
| 1,919,340 | 7/1933 | Lyford | 188/72.7 X |
| 3,028,619 | 4/1962 | Schlage et al. | 16/50 X |
| 3,172,071 | 3/1965 | Ihrig | 188/72.7 X |
| 3,801,155 | 4/1974 | Hodgen et al. | 16/342 X |
| 4,982,453 | 1/1991 | Matsumoto | 4/248 |
| 5,153,946 | 10/1992 | Yoke et al. | 4/248 |

FOREIGN PATENT DOCUMENTS

| | | | |
|---|---|---|---|
| 6142005 | 5/1994 | Japan | 4/248 |

*Primary Examiner*—Robert M. Fetsuga

[57] ABSTRACT

An automatic toilet seat lowering device integrated into a seat hinge assembly such that a raised seat, when approaching the last ten degrees of upward travel, is latched against the bias of a torsion spring. A rod connected to a flush handle unlatches the seat to allow the spring to bias the seat into an initial stage of descent. During descent, a leaf-type spring on the seat engages a catch on a lid to pull the lid into the descent. The speed of descent of seat and lid is controlled by friction between rotating and non-rotating brake discs mounted on an extension of an axle of the hinge assembly. The brake discs are compressed between a thrust cam driven by the descending seat and a compression spring mounted on the axle. Some of the brake discs are further configured to perform additional functions such as latching the seat in the raised position, and protecting the hinge assembly from excessive-force damage as well as enabling adjustment for differing seat thicknesses.

9 Claims, 2 Drawing Sheets

AUTOMATIC DOMESTIC TOILET SEAT LOWERING APPARATUS AND DISC BRAKE ASSEMBLY

BACKGROUND OF THE INVENTION

Since the invention of the raisable toilet seat there has been tension between male and females about males leaving said raisable toilet seats raised. While this vexation cannot, on the scale of world events, be considered very consequential, there is on the other hand no good reason for the problem to exist at all!

Yet it has, and for generations! Indeed, there have been some strikingly imaginative solutions put forth by inventors in the last 50 years or so but all of them, without exception, lacked one essential ingredient: they lacked sufficient economic rationality to induce a manufacturer to take a chance on them. This in spite of the fact that in the United States alone, there are in excess of 200 million commode seats, virtually every one of which has a finite life expectancy, perhaps as short as ten years, and all share certain almost identical physical specifications. The correct solution could reap a windfall of the first magnitude.

In order to be economical rational in the instant case, the cost of solution must have a very subtle impact on the sales price of a conventional seat hinge inasmuch as the problem it solves, while certainly universal, is also very subtle. Unhappily, or more properly happily, nothing in the patent statutes require that a patent be economically rational. It is however, this "economical rationality" that is the sine qua non of my invention. Without this absolutely essential economic rationality, my invention, like all those before it, would be just another abstract intellectual exercise, signifying nothing.

While somewhat simplistic, it is however essentially true, based on potential annual hinge sales volume, the extra cost of the very modest alterations required to upgrade existing conventional hinge molds; the miniscule costs of the normal low-grade plastic hinge material for the extra axle length required, the cam, follower and discs; and the pocket change expense of the three simple springs and rod brings my proposed assembly into play for pennies. The profit potential in dollars of these few pennies is significant.

PRIOR ART STATEMENT

While the prior art of automatic toilet seat lowering is strong and long, an examination of the existing patents revealed no application this layman could recognize of disc brakes or their equivalent to slow the seat descent; nor the application of these same brake discs to provide vertical seat arrest and release means; nor of use of the disc brakes to also enable it to adjust itself to accomodate any seat thickness or any tank and/or lid thickness decorative fabric cover; nor of the use of a leaf-type spring for the seat assembly to capture the lid assembly, nor an axle-mounted tortion spring to both initiate and to then resist seat descent.

My own patent U.S. Pat. No. 4,914,757, dated Apr. 10, 1990 does use a capture spring that locks on to the other member and unlocks when the seat and lid are both down but in this invention it is the lid that is hydraulically braked and it is the seat that is being captured—an entirely different proposition.

OBJECT OF THE INVENTION

The present invention has its first philosophical object the elimination of the inconvenience, trauma, possible injury, and the understandable irritation of any person who might use a toilet in the dark thinking the seat is down when it is not.

A second philosophical objective of the invention is to encompass in a single hinge device, all of the functional objectives itemized below and in a fashion that is so adaptable to conventional toilet seat geometry as to be virtually universal. Moreover that a layman may easily install the device using the simplest of hand tools, generally only a screw driver.

A third philosophical objective, not far removed from the second, but in fact the sine qua non of the invention, is that the device provide the functional objectives itemized below, and to do so in a fashion that can be produced at a price that is economically rational and attractive to a majority of the general buying public.

As to functional objectives, the first is to provide for the retention jointly of the toilet seat and lid in the upright position while in use by a male and to then cause the set to automatically and gently descend after use, to wit, when flushed.

Another objective is that the device allow the manual raising of the lid independent of the seat.

Another objective is to provide for an override of the control mechanism such that the toilet seat, if raised, may be unlatched and lowered manually without flushing if desired; or, if forced to lower while in the upright locked condition, may do so without damage to the assembly.

Another objective is to enable the device to adjust itself to accomodate any thickness of seat and/or the additional thickness of decorative tank/lid fabric covers.

SUMMARY OF THE INVENTION

An automatic toilet seat lowering device integrated into the flush-side seat hinge assembly, such that the raised seat, when approaching its last ten degrees of upward travel cocks and locks a torsion spring which, when unlatched by a rod connected to the commode flush handle, catapults the seat into an uninhibited initial stage of descent, said descent once started and momentum established, a stiff leaf-type spring on the seat assembly engages a "catch" on the lid assembly to pull the lid also into the free-falling descent, the two members then to be brought into a controlled descent by brake discs, mounted on an extension of the hinge axle to the left of the seat hinge member, which are compressed between a thrust cam driven by the descending seat, and a compression spring locked to the end of the axle.

Three of the leftmost brake discs are further configured to perform additional functions, to wit, a small "U" shaped notch in one disc and an arrest spring which flexes into the notch to lock the seat in the raised position against the bias of the aforementioned cocked torsion spring. Secondly, a narrow vertical slot in the leftmost non-rotatable disc prohibits any horizontal flexing such that the arrest spring may only be disengaged vertically from the notch by a stiff rod connected to the spring and the flush handle. Thirdly, sinuous opposing faces between the second and third leftmost discs which combine (a) to protect the assembly from possible damage caused by being forced down manually when locked in the upright position and (b) to enable the assembly to adjust itself to any thickness of seat or decorative tank/lid fabric covers, that might be encountered either as a replacement hinge assembly or in the product line of a manufacturer.

DESCRIPTION OF THE DRAWINGS

NOTE: All elevations displayed are of the components in the "raised seat" position.

PREFERRED EMBODIMENT

Inasmuch as the disc brake assembly is the essence of this invention it will be described first in some detail, then how the assembly interplays with the rest of the system will be demonstrated step-by-step. In the following "preferred embodiement" discussion and in the claims the following apparatus directions are used: "right" or "left" assumes facing flush-handle-side hinge assembly from bowlside,i.e. left is in direction of flush handle; "outward" means radially outward from axle shaft or hinge member axle centerpoint; "up" is vertical from top of bowl surface. Alternate embodiements are discussed parenthetically when appropriate.

Figures 1A, 1B, 1C, 1D:
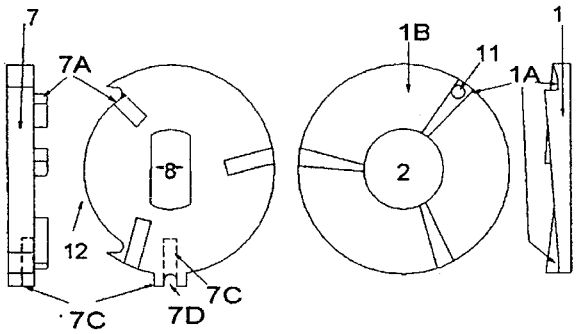
FIGS. 1*a*–1*d:* Front and right elevations of follower member 7 showing three convex followers 7A, centered bottom protrusion 7B, bore 7C, notch 7D, 100-degree "indents" 12, and axle-shaft flats 8; left and front elevations of thrust cam 1 showing 10-degree flat surfaces 1A, 110-degree inclined surfaces 1B, round axle shaft accomodation aperture 2 and rotator rod aperture 11.
Figures 2A, 2B, 2C, 2D:
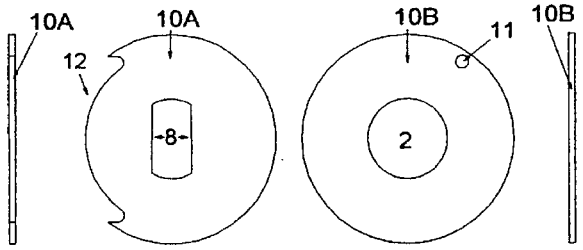
FIGS. 2*a*–2*d:* Front and right elevations of non-rotatable friction disc 10A showing indents 12 and axle shaft flats; left and front-elevations of rotatable friction disc 10B showing axle-shaft aperture FIGS. 3*a*–3*d:* Front and right elevations of torque clutch arrest member 15A showing cam protrusion 15D, arrest notch 15E, and sinuous face 15C; Left and front elevations showing torque clutch second member 15B showing sinuous face 15C and rotator rod aperture 11.
Figures 3A, 3B, 3C, 3D:
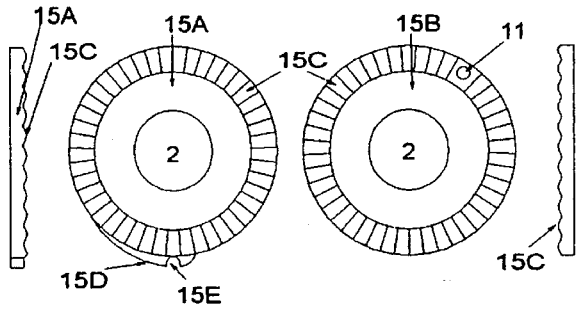
Figures 4A, 4B:
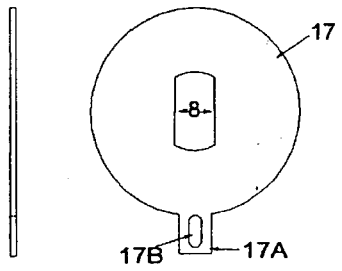
FIGS. 4*a* and $_4$*b* Front and right elevations of slotted disc 17 showing axle shaft flats, bottom protrusion 17A and slot 17B.
Figure 5:
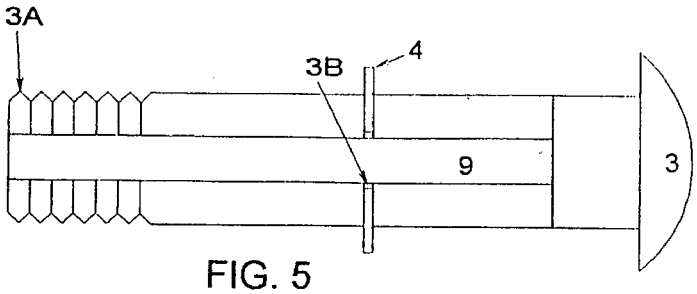
FIG. 5 Front elevation of horizontal axle shaft showing round portion 3, one of two flats 9, threaded end 3A, retention slot 3B and retention spring 4.
Figure 6:
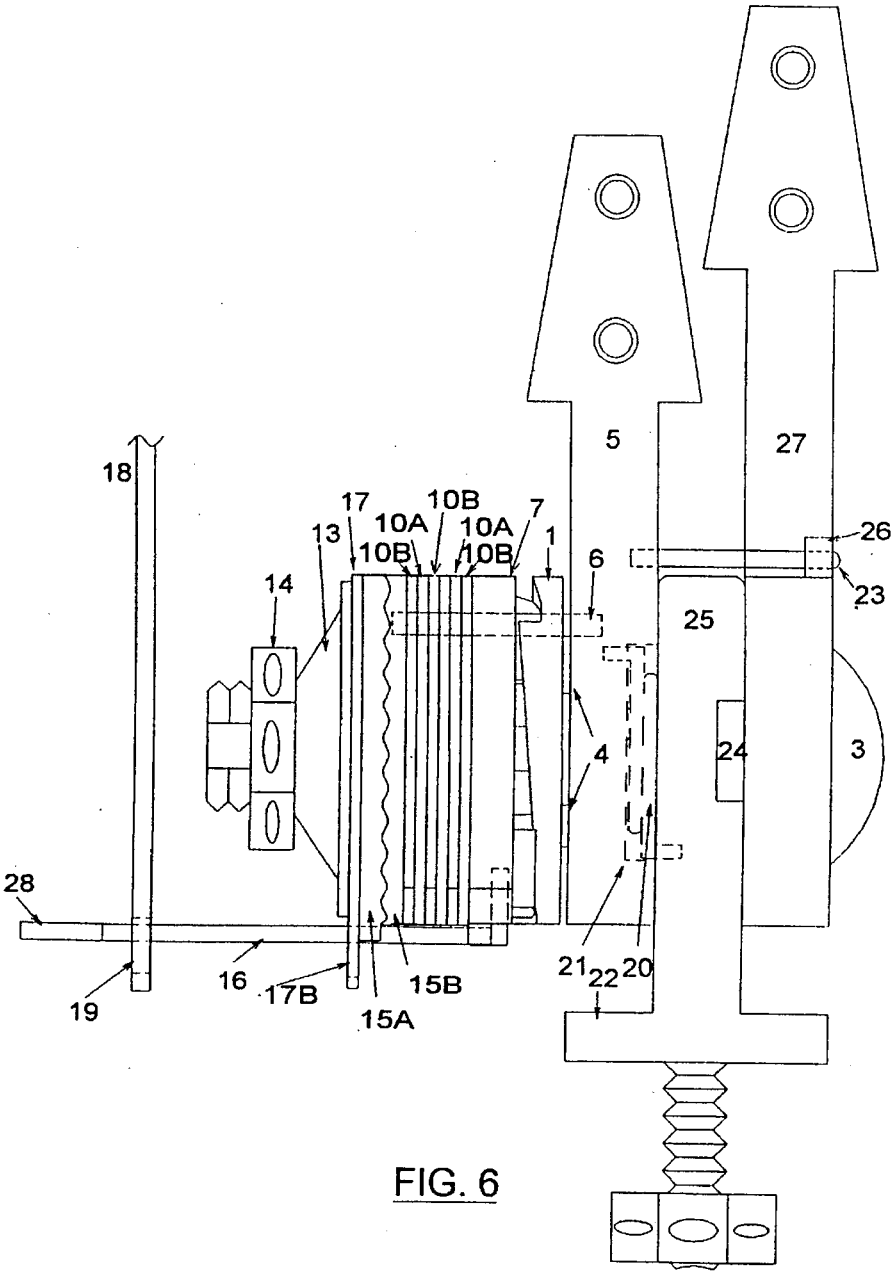
FIG. 6 Front elevation of the assembled hinge and brake mechanism showing those elements not shown in previous drawings, to wit, lid member 27, bowl anchor member 25, seat member 5, rotator rod 6, disc-type compression spring 13, adjustment nut 14, flexible arrest spring 16, flush rod 18, elongated slot 19, finger tab 28, coiled torsion spring 20, in recessed cavity 21, bowl-anchor base 22, lid capture spring 23, capture catch 26, and capture release cam 24.

FIGS. 1 thru 6: Disc-Brake Mechanism

Inasmuch as the radial length of seat travel from horizontal to vertical is ninety degrees, but may extend in some tank/seat configurations to a much as 100 degrees, the first element of the system, the radial-to-linear-travel converter "thrust cam" I consists of a circular disc with a round axle shaft aperture 2 piercing it at centerpoint, its right face flat, and its left face divided into three 120-degree sectors, the largest number of identical sectors that will each sweep a 100 degree arc, the surface of each identical sector being flat for ten degrees 1A to then begin an approximate 15-degree incline in tankward rotational direction for the remaining 110 degrees of sector face 1B, reaching its thickest dimension at the end of the 120 degrees. (Said "15-degree" face incline, if desired, may be varied at points along the face to lag, meet or exceed the exponentially increasing turning-moment curve of the descending seat.)

This thrust-cam member can rotate on the axle shaft 3 and is restrained from sliding in the rightward direction by a retaining ring 4 on the shaft located in slot 3B between it and seat hinge 5. The thrust cam is fixedly connected, across the retainer ring, to the seat hinge by a steel rotator rod 6 passing thru a small radius aperture 11 in one of the 10-degree flat-sector sections near the perimeter, which forces the thrust cam to rotate around the axle shaft when the seat is raised or lowered. (The single steel rotator-rod is the preferred technique but a second and equally attractive technique might be one or more male protrusions on the right face of the thrust cam interlocking with female receptacles in the left face of the seat member. Or, as is more likely, the thrust cam might be molded as an integral part of the seat hinge assembly itself.)

The second element, the cam follower disc 7, has a flat left face, not shown, and a flat right face having three narrow convex cam followers 7A radiating outward at 120-degree intervals. The convex cam followers are gently pressed against the 10-degree flat surfaces of the thrust cam by a compression spring, discussed below, when the seat is in the raised position.

The cam follower disc 7 has a circular axle-shaft aperture with two vertical flats 8 piercing its centerpoint such that the cam follower disc is locked to the fixed axle shaft 3 by the shaft flats 9 and cannot rotate, but can slide longitudinally along the axle shaft when forced to do so by the rotating inclined surfaces 1B of the thrust cam.

The slotted protrusion 7B at the bottom of member 7 contains an approximate 0.07 inch diameter vertical bore into which is fixedly inserted the short right angle end of the flexible rod type spring 16, of same approximate 0.07 inch diameter.

Non-rotatable axle shaft 3 is fixedly attached to bowl-anchor member 25 thru "flatted" axle shaft aperture.

(Both axle shaft and bowl anchor aperture could have a single flat, be splined, notched, keyed, or otherwise configured to prevent axle shaft rotation. By like measure the non-rotatable cam and discs could be similarly configured to match the axle shaft. Two axle flats, however, are the preferred configuration. Additionally, the function of the cam and follower described in my invention could also be realized by internally reverse-threading the seat member axle shaft aperture to be then mounted onto a reverse-threaded shaft such that the seat moves horizontally to the left on the threads as it rotates down; or, in another configuration, the edges of the seat and anchor post can be "beveled" or inclined against each other and "overlap" such that the seat member is thrust horizontally leftward along the shaft as the seat drops and the inclined edge of the seat hinge member impinges against the reverse angle of the post. The horizontal travel to be then resisted by any number of compression spring configurations. During the last few degress of drop, the seat member could compress a spring or hydraulic piston on the bowl-anchor member or the commode surface to dampen the final impact.)

The third element is friction disc types 10A & 10B alternately positioned on the axle shaft leftward of the cam follower, every other disc having a round or a flatted aperture. The rotatable discs 10B, those with round axle-shaft apertures, also have an aperture 11 at their outside perimeter. Stiff inflexible steel rotator rod 6 emanating from seat hinge 5 passes thru the perimeter aperture in the thrust cam and the rotatable friction discs, forcing them all to rotate in concert around the axle shaft as the seat is raised or lowered.

While the illustrations show, and the claims refer to, the brake and cam plates as circular discs, the disc configuration for the plates is initially selected as that having the most braking surface area per unit of brake assembly volume, however it is hereby declared that the circular configuration is not critical to this invention and that other plate configurations are equally valid, and in some embodiements even preferred.

There are "indents", 100-degree arc sectors of reduced radius 12, in the outer perimeter of the non-rotatable cam follower disc 7 and the non-rotating discs 10A, those with flatted axle shaft apertures, to enable the rotator rod to move up and down freely as the seat is raised or lowered.

The fourth element is a disc-type compression spring 13 which when the seat is in the raised position gently presses against the left face of the leftmost of the friction discs 17 and is held in place by a spring-tension adjustment nut 14 threaded onto the axle shaft leftward of the spring.

The retainer ring 4 residing in slot 3B prevents intense braking pressure, when it is developed, from reaching the actual seat hinge assembly to the right of it, the plastic material of which may flow, compress or otherwise distort under the maximum pressure when the seat is down, particularly if for an extended time, thus altering the compression adjustment of the assembly and perhaps diminishing the braking effect of the compressed friction discs.

The fifth element, not strictly a part of the braking system but does impact it directly, is the seat-descent-initiation coil-type torsion spring 20, encircling the axle shaft in a recessed cavity 21 in the seat hinge member with one leg anchored to the seat hinge member and the opposing leg anchored to the bowl-anchor member. The configuration of the spring is such that it is in repose when the raised seat is approximately 10-degrees from its final upright resting place. This ten degree point of repose is generally 5-degrees off vertical in the forward direction inasmuch as vertical seats normally lie 5 degrees back of vertical against the lid which, in turn, is against the tank.

It is considered important that the initiation torsion spring complete its thrusting task when the seat has been impressed into the 5-degree falling position because at that point the seat will unquestionably continue its decent under its own weight, and any additional impetus by the spring beyond the 5-degree point only adds energy to the falling seat that must be then absorbed by the other elements of the brake assembly in slowing the seat descent. Even though it must unload quickly, i.e. in ten degrees, the torsion spring can have considerable authority inasmuch as even a very stiff spring can be easily flexed by the 15-inch toilet seat turning arm when the seat is manually raised.

(The function of this initiation torsion spring can be accomplished via a number of spring configurations, the simplest being a straight rod-type spring extending from the seat member which impinges on the bowl-anchor base 22 and flexes, or a coil spring compressed between seat and bowl-anchor base, as the seat is raised.)

When the seat is raised then to its final upright position, the torsion spring has been baised 10 degrees in the downward direction. If the seat were not arrested, it would be immediately launched back down toward the bowl by the torsion spring.

The sixth element, and like the fifth element not exactly a part of the braking mechanism itself but instead, part of the control of the braking process, to wit, a small inverted "U" shaped notch 15E, hereinafter referred to as "arrest notch" in the cam protrusion 15D at the bottom of rotatable torque clutch disc 15A, hereinafter referred to as "notched disc". When said notched disc being in the "raised seat" position, said arrest notch pierces said bottom perimeter of said cam protrusion at bottom of said notched disc appoximately 0.07 inch, said notch being approximately 0.07 inch wide. Additionally, when said notched disc rotates to the position corresponding to the raised seat condition, said arrest notch is vertically aligned with the vertical control slot 17B, to be discussed later, and can be entered by the flexible rod-type "arrest" spring 16, also to be discussed later, thus "arresting" said arrest notch, and by extension the seat, in that "raised" position until the arrest spring is disengaged from the notch.

Essential to the control of the "arrest" spring flex action is vertical slot 17B in a protrusion 17A at the bottom of leftmost disc 17, hereinafter referred to as "slotted disc", which is non-rotatable and thru which passes the arrest spring 16 in its leftward journey to engage the flush rod. The function of vertical slot 17B, hereinafter referred to as "control slot", is to allow vertical flexing of the arrest spring as it enters and exits the arrest notch, but to allow no horizontal flexing of the arrest spring. If horizontal flex were possible, the arrest spring 16 would simply "pop out" of the arrest notch 15E when the notched disc 15A attempts to rotate in the down direction; thus negating the essential arresting function of the arrest spring.

The seventh element is the previously mentioned "arrest" spring, a straight rod-like flexible spring 16, hereinafter referred to as "arrest spring", having a right angle bend with short end fixedly inserted into 0.07 inch diameter bore 7C in protrusion 7B at bottom of non-rotatable cam follower member 7, long end extending horizontally thru notch 7D leftward such that the arrest spring impinges on the bottom cam perimeter 15D of the rotatable notched disc 15A biased upward to enter and engage the arrest notch, if available. The arrest spring 16 continues leftward thru the vertical control slot 17B in the non-rotatable slotted disc 17, to pass thru the upper end of an elongated slot 19 at the bottom end of the vertical "flush rod" 18. When the toilet flush handle is depressed, the flush rod 18 pushes down on the arrest spring disengaging it from the arrest notch, thus releasing the notched disc, and by extension the seat, to swivel forward in response to the thrust of the descent-initiation torsion spring 20.

The "arrest" spring 16, after passing through the elongated slot 19 at the bottom of the flush rod 18 terminates in a flat horizontal override finger-tab 28 such that, if the seat is desired to be lowered without flushing, the override finger-tab may be pressed down manually to disengage the arrest spring 16 from the notched disc 15A. The slotted connection 19 allows this override to occur without pulling down on the flush handle. Additionally, the slot connection 19 allows the flush handle to freely re-position itself in its normal fashion during the flush operation.

It is expected that until the automatic operation of the invention becomes totally ingrained, there will be instances when the user intentionally, or unintentionally, lowers the lid in the conventional fashion. The very high torque created by the 15-inch toilet seat being forced down manually, while the arrest spring is engaged in the arrest notch, could well damage the assembly.

The torque clutch 15A and 15B enables this conventional seat lowering to occur without damage, if need be, indefinitely; for example: firstly, if downward damaging turning moment is applied to the arrested seat, the torque clutch having as a left member the previously described rotatable notched disc 15A, and as a right member rotatable disc 15B, the adjacent faces of the two members each having sinuous undulations normally held in firm interface against each other by the bias of the disc compression spring 13 such that they do not easily slide against each other, but in the case of forced descent, the increasing torque between the notched left clutch member 15A, still arrested, and the right clutch member 15B, locked to the descinding seat hinge member 5 by rotator rod 6, overcomes the bias of the disc-type compression spring enabling the faces to slide over themselves before damage to the mechanism can occur, and to do so until the descending seat is fully down.

When the seat is to be again raised, the arrest notch 15E, now 90 degrees out of phase from where it should be in the "down" seat condition, is "reset" to the proper position by manually raising the seat against this "locked" notch disc causing the clutch faces to again slide against each other, but now in the reverse direction, for 90 degrees, until the seat is totally raised, thus re-establishing the status quo of the assembly and to be again ready for automatic operation. (Another solution, less preferred because it lacks the "reset" capability of the sinuous face solution, is to employ a "V" shaped notch rather than the "U" shaped notch 15E. The inclined sides of the V successfully resists the action of the torsion spring 20 but cannot resist the more powerful turning moment of a deliberately lowered seat such that the trailing inclined side of the "V" notch forces the arrest spring 16 out of the arrest notch 15E, enabling the seat to drop without damage to the mechanism.)

This "reset" ability of the sinuous faces of the torque clutch also plays a critical role in another important feature of the assembly, to wit, to automatically adjust itself for thickness of any possible seat or decorative tank/lid fabric cover that might be encountered when installed as a replacement hinge assembly by the user, or applied to a varied product line of seats by a manufacturer as follows: the arrest notch, always initially positioned by the manufacturer to accomodate a seat of zero thickness, the seat is raised until the arrest spring engages the arrest notch, and is then deliberately continued to be raised, against the "locked notch" restraint, forcing the sinuous faces to slide until the particular seat is totally raised, at which time the sinuous faces stop sliding, crests and troughs re-interface and are then firmly held by the disc-type compression spring in that relative position, accomodating that particular seat.

(The flush-rod function previously discussed can be accomplished by the use of a "Bowden cable", or a low voltage solenoid to disengage the arrest spring, said solenoid triggered by a waterlevel switch inside the tank, or mercury switch affixed to the handle, or a momentary push button switch. In fact, the flush rod can be dispensed with entirely, such that the arrest spring is always triggered manually and totally independent of the flush handle, or a solenoid as mentioned above can serve the function of the arrest spring itself by arresting the notched disc directly or otherwise impeding the release of the initiation spring or the descent of the seat until electrically energized. It is additionally possible to have a spring driven cam, or the aforementioned solenoid, force the arrest spring out of the arrested notch after a predetermined time interval thus making the seat/lid lowering activity entirely automatic and independent of any user initiative or action whatsoever.)

Of incidental information, the brake assembly, elements one thru four, can be seperately assembled as an independent module on a semi-flattened tube flared at the right end to retain the thrust cam as does the retainer ring, and threaded at the other to accomodate the lock nut, the brake module to be then assembled and slipped onto the "flatted" axle shaft or otherwise locked to the shaft. The functional advantage of this technique is that the tube absorbs all the stress generated by the cam and disc spring interaction. There may be manufacturing advantages as well.

FIG. 1 thru 6: Mode of Operation:

Inasmuch as the disc brake mechanism has now been described in detail, what follows hereinafter is a description of how a toilet seat/lid assembly equipped with the disc brake mechanism is to operate.

There are several ancillary features of the invention, seperate from the disc brakes, that play a significant role in its operation, particularly the lid-capture spring and capture catch in conjunction with lid-capture release, which enable the toilet lid as well as the seat, to be closed by the invention but also, the lid to be raised manually, independent of the seat, which of course, is an unassailable requirement of a successful invention for this purpose.

When toilet lid, attached to lid hinge member 27 and toilet seat, attached to seat hinge member 5, are in the closed position, leaf-type lid-capture spring 23 approximately 0.2 inches wide and extending approximately 1.0 inch has been lifted by lid-capture lift cam 24 strategically placed on bowl anchor member 25, such that capture catch 26 can travel under the leaf-type spring when lid member 27 is seperately raised.

When toilet seat and lid are raised together in the conventional manner, ten degrees before the seat reaches its upright resting place against the toilet tank, the initiation torsion spring 20 begins to resist the travel of the seat and assumes a strong bias in the closing direction at the point the arrest spring 16 engages the inverted "U" notch 15E, locking the seat in the upright position against the bias of the initiation torsion spring 20.

If the lid is raised first, and then the seat, the action is that the lid capture spring 23, anchored to seat member 5 is raised by the seat member to ride up and over the inclined face of the capture catch 26 on lid hinge member 27 and to travel approximately ten degrees past the catch until the arrest notch is engaged.

Additionally, when the seat is in its upright position, the three convex cam followers 7A are pressed gently against the three ten-degree flat surfaces 1A of the thrust cam by the disc-type compression spring 13 which itself is in a relaxed, virtually neutral condition.

When the toilet is flushed, the flush rod 18 attached to the tank flush handle, not shown, presses down on arrest spring 16 disengaging it from notch 15E thus in effect freeing seat to be thrust by the initiation torsion spring 20 from its arrested position 5 degrees in the tank direction into a five-degree descending mode.

The seat, being essentially vertical, requires little thrust to make this move, but to further insure this initial seat movement, the disc-type compression spring 13 is in virtual repose, and the interfaced cam faces for the first ten degrees of travel are neutral, so as to present no needless resistance to the initiation torsion spring thrust.

At the "ten degree" point the seat, now tilted 5 degrees forward, begins to fall of its own weight and the torsion spring 20 designed to reach neutral at the 10-degree point, now begins to resist the descent of the seat and does so increasingly as the seat drops. Also at the ten-degree point, the lid-capture spring 23 has closed the ten-degree gap between itself and the lid capture catch 26, and any further descent of the seat will cause the lid-capture spring 23 to engage the lid-capture catch 26 and to pull the lid along with the seat. The seat has been spared the load of the lid until the seat receives the full thrust of the torsion spring and develops enough momentum in its fall to pull the lid along with it. As the braked seat descends, the unbraked lid catches up to it and rests on the seat as they make their mutual descent.

The final braking of the seat/lid is accomplished by the disc brake assembly as follows: as the thrust cam 1 rotates past the 10-degree point, the 110 degrees of the thrust cam with leftward inclined faces begin to drive the three convex cam followers 7A on the non-rotatable cam follower disc 7 and the 10A and 10B friction discs along the shaft 3 in the leftward direction. The disc-type compression spring 13, in virtual repose when the seat was in the upright position, begins now to strongly resist the leftward lateral sliding movement of the friction and follower discs, which in turn slows the rotation of the driving cam and the falling seat. More importantly, the discs are increasingly squeezed together, exponentially increasing the surface friction of the rotating discs against the non-rotating discs, the effect of which is to slow the rotation to any desired rate. Increasing or decreasing the pressure of the adjustment nut 14 controls the rate of descent.

In summary, the interaction of the slope of the cam faces, the friction of the brake discs, the compression of the disc spring, and the position of the adjustment nut, plus the reverse resistance of the torsion spring, serve to slow the seat and accompanying lid into an orderly descent and soft landing on the surface of the commode bowl. Lastly, as the seat/lid set approach horizontal, the lift-cam on the bowl-anchor member lifts the lid-capture spring off the lid-catch such that the lid is free to be raised next time independent of the seat.

Not only the geometric design of the brake assembly, but the match of the assembly components is an important consideration, to wit, the angle of the thrust cam face slopes may be increased or decreased to alter follower horizontal-travel per degree of radial-travel; the compression value of the spring may be increased or decreased; the spring-tension nut tightened or loosened; the friction coefficient, configuration, or number of friction discs, may all be varied by a manufacturer to produce the optimum, or desired, braking interaction.

A cosmetic cowling most likely would be utilized by a manufacturer, to conceal the entire spring/disc/cam/nut of the disc brake to make the hinge assembly more esthetically pleasing and to be easily cleanable.

In a second embodiement, it is possible to: construct thrust cam 120 degree faces to be inclined in opposite rotational direction, reverse the order of the components on the shaft, add a flexible "Bowden cable" in lieu of flush rod between flush handle and arrest spring, then to use the newly configured assembly as a controlled right-side seat hinge/lid assembly. More likely, however, it would be used on the right side, said Bowden cable, lid-capture and arrest spring, as a "slave" adjunct to the controlled left, flush-side, brake assembly for certain very heavy toilet seat/lid materials.

While the preceding description and the associated illustrations focus on the preferred embodiement of the invention, it is quite possible to vary or modify the device substantially without departing from the spirit and scope of of the invention as shown in the various examples above and otherwise. I intend that my invention extends to all such variations or modifications as come within the scope and spirit of the following claims, individually or in toto.

I claim:

1. A brake apparatus for use with a toilet seat and lid hinge assembly including a right-hand hinge and a left-hand hinge each having a seat hinge member and a lid hinge member rotatably mounted to an anchor member, said anchor member suitable for fixedly attaching said hinge assembly to a bowl of a toilet, said brake assembly comprising:

an axle shaft fixedly mountable to said anchor member for rotatably mounting one pair of said seat and lid hinge members;

brake means mounted on an extended portion of said axle shaft for slowing descent of said seat, said brake means including a plurality of rotatable friction discs slidably and rotatably mounted on said axle shaft, said rotatable friction discs fixedly attachable to said seat hinge member, a plurality of non-rotatable friction discs slidably mounted on said axle shaft, a thrust cam mounted rotatably and a cam follower mounted slidably to said axle shaft on one side of said discs, and a compression spring mounted to said axle shaft on an opposite side of said discs;

means for arresting seat descent including a notch in a perimeter of one of said rotatable friction discs, and a rod-type arrest spring fixedly attached to said cam follower and extending therefrom to an end portion beyond said compression spring, said arrest spring being biased toward and engaging said notch when said seat hinge member is in a raised position;

seat arrest release means including a flush rod for releasing said arrest spring from said notch;

seat descent initiating means including a torsion spring having a first end attachable to said seat hinge member and a second end attachable to said anchor member; and lid capture means for releasably securing said seat hinge member to said lid hinge member.

2. An apparatus as recited in claim 1, wherein said axle shaft includes two diametrically opposed flat surfaces.

3. An apparatus as recited in claim 1, wherein said axle shaft includes a stop on one end and a threaded opposite end, said threaded end having a nut thereon for adjusting the compression spring bias.

4. Art apparatus as recited in claim 1, wherein said thrust cam comprises a circular disc including a centered round axle shaft aperture and three 120 degree sectors, each of said sectors having a flat 10 degree section and a 110 degree section inclined at approximately a 15 degree angle, a rotator-rod aperture located in one of said flat sections adjacent the disc perimeter, said cam follower comprises a circular disc including a centered flatted axle shaft aperture and three cam followers at 120 degree intervals, said cam follower further comprising a 100-degree arc sector and an arc protrusion on the perimeter thereof, said arc protrusion having a notch and vertical bore for receiving said arrest spring, most of said rotatable discs comprise a centered round axle shaft aperture and a rotator rod aperture adjacent the perimeter thereof, most of said non-rotatable discs comprise a centered flatted axle shaft aperture and a 100 degree arc sector, said rotatable discs and said thrust cam being fixedly attachable to said seat hinge member by a rotator rod engaging said rotator rod apertures.

5. An apparatus as recited in claim 1, wherein said rotatable disc having said notch is adjacent said compression spring, a perimeter of said notched disc including a protrusion having said notch formed therein, said seat arrest means further including one of said non-rotatable discs being adjacent said compression spring and having a protrusion on a perimeter thereof, said non-rotatable disc protrusion having a vertical slot, said arrest spring passing through said vertical slot.

6. An apparatus as recited in claim 1, wherein said seat arrest release means includes override means for releasing said arrest spring independent of said flush rod, said override means including an elongated aperture in one end of said flush rod through which passes said arrest spring, said end portion of said arrest spring terminating in a finger tab.

7. An apparatus as recited in claim 1, wherein said torsion spring is biased to resist upward rotation of said seat hinge member at approximately 85 degrees from horizontal, and to resist downward rotation at said approximately 85 degrees.

8. An apparatus as recited in claim 1, further comprising damage protection and seat adjustment means including two of said rotatable discs being adjacent one another and defining a torque clutch, said torque clutch discs including mutually adjacent faces having sinuous undulations pattered and dimensioned to precisely interlock.

9. An apparatus as recited in claim 1, further comprising compression relief means including a spring retainer ring mounted in a circumferential slot in said axle shaft between said thrust cam and said seat hinge member.

* * * * *